US006209274B1

(12) United States Patent
Crigler

(10) Patent No.: US 6,209,274 B1
(45) Date of Patent: Apr. 3, 2001

(54) VENT FLOW APPARATUS AND METHOD

(75) Inventor: John R. Crigler, Raleigh, NC (US)

(73) Assignee: VSL International, Lyssach (CH)

( * ) Notice: Subject to any disclaimer, the term of this patent is extended or adjusted under 35 U.S.C. 154(b) by 0 days.

(21) Appl. No.: 09/311,439

(22) Filed: May 14, 1999

Related U.S. Application Data

(63) Continuation-in-part of application No. 08/797,690, filed on Jan. 31, 1997, now Pat. No. 5,939,003.

(51) Int. Cl.[7] ..... E04C 5/08
(52) U.S. Cl. ..... 52/223.13; 264/228
(58) Field of Search ..... 264/228, 229; 52/223.1, 223.13, 223.14

(56) References Cited

U.S. PATENT DOCUMENTS 4,799,307 * 1/1989 Reigstad et al. ..... 264/228
5,540,030 * 7/1996 Morrow ..... 264/228
5,939,003 * 8/1999 Crigler et al. ..... 264/228

FOREIGN PATENT DOCUMENTS

2603928 * 3/1988 (FR) ..... 52/223.13

* cited by examiner

*Primary Examiner*—Richard Chilcot
(74) *Attorney, Agent, or Firm*—Jenkins & Wilson, P.A .

(57) ABSTRACT

A vent flow apparatus and method for general application in venting and filling air pockets in conduit or duct type apparatuses designed for passage of material therethrough is provided including a hollow vent flow conduit preferably in the form of a tube having an entry opening and a downstream exit opening with both openings being in communication with a duct for flow of material therethrough. The entry opening is in communication with the duct at a first location of greater cross-sectional area of the duct than a second location of communication of the exit opening with the duct. The vent flow conduit has particular applicability for post-tensioning systems for concrete or other suitable structures, particularly post-tensioning systems which include body sections interconnected in series by an intermediate anchor head and which use a transfer means for routing grout between the body sections and around the intermediate anchor head.

19 Claims, 9 Drawing Sheets

VENT FLOW APPARATUS AND METHOD

RELATED APPLICATIONS

This is a continuation-in-part application from U.S. patent application Ser. No. 08/797,690, filed Jan. 31, 1997, now U.S. Pat. No. 5,939,003.

TECHNICAL FIELD

The present invention relates generally to venting apparatuses and methods. More particularly, the present invention relates to a vent flow apparatus and method for venting and preventing air pockets in conduit or duct type apparatuses designed for flow of a material therethrough, with particular applicability for post-tensioning apparatuses for concrete or other suitable structures.

BACKGROUND ART

For elongated conduit or duct type apparatuses for passage of material therethrough, it is common for the material passing through such conduit to incompletely to fill certain internal portions thereof so as to cause formation of air pockets therein. For example, elevated portions of a curved conduit have been found to be particularly susceptible to formation of air pockets in internal sections thereof. This susceptibility of air pocket formation can occur in a variety of environments or areas and typically does not depend on the type of material passing through the conduit.

Post-tensioning apparatuses or systems for concrete or other suitable structures typically utilize elongated conduits or ducts for passage of a hardenable material such as grout through the conduit. Since it is also common for post-tensioning apparatuses to include curved conduits comprising portions of higher and lower elevations, such post-tensioning apparatuses have particular susceptibility to formation of air pockets in elevated portions thereof where grout will usually not completely fill. As can be appreciated by those of skill in the art of post-tensioning apparatuses and methods, it has therefore been common in the past to utilize vertical vent pipes which communicate with elevated, curved portions of an elongated conduit on one end and communicate on the opposite end with environment outside the material, such as concrete, that surrounds the post-tensioning system in order to pass grout through the vent pipe to completely fill the conduit, including the elevated portions thereof.

The use of such vent pipes suffers from many disadvantages, including forming a weak point in the post-tensioning system, acting as a natural pathway for contaminants to enter the internal portions of the post-tensioning system such as de-icing salts, and also providing much difficulty in the concrete pouring and finishing processes. Even in post-tensioning systems of the type disclosed in Parent patent application U.S. Ser. No. 08/797,690, commonly owned herewith and specifically incorporated by reference herein, there typically are body section portions adjacent to an intermediate anchor head which typically are prone to formation of air pockets in internal portions thereof despite the use of a transfer means for routing grout from a first body section, around and past the intermediate anchor head, and into an adjacent, second body section.

In light of the prior art as discussed hereinabove, it is apparent that there remains much room for improvement in the art of venting and preventing formation of air pockets in conduit or duct type apparatuses for passage of material therethrough, particularly for post-tensioning systems for concrete or other suitable structures.

DISCLOSURE OF THE INVENTION

In accordance with the present invention, a vent flow apparatus and method are provided for general application in venting and filling air pockets in conduit or duct type apparatuses designed for passage of material therethrough. The vent flow apparatus comprises a hollow vent flow conduit having both an entry opening and a downstream exit opening with both of the openings being in communication with a duct for flow of material therethrough. The entry opening of the vent flow conduit is in communication with the duct at a first location of greater cross-sectional area of the duct than a second location of communication of the exit opening of the vent flow conduit with the duct. Typically, the first location of communication of the entry opening of the vent flow conduit with the duct is elevationally higher than the second location of communication of the exit opening of the vent flow conduit with the duct, although it is envisioned in accordance with this invention that other arrangements could also exist. In a preferred embodiment, the vent flow apparatus comprises a tube positioned entirely within the duct. The vent flow conduit has particular applicability for post-tensioning systems for concrete or other suitable structures which include a duct for passage of a hardenable material therethrough. Utilizing the method of the present invention, an elongated conduit, such as that of a post-tensioning system for a concrete structure or any other suitable elongated conduit of associated with another suitable system or environment, can be filled completely with material without formation of air pockets and without the use of external vent pipes.

In an embodiment adapted for applicability with post-tensioning systems which include a transfer means for routing grout from a first body section, around and past an intermediate anchor head, and into a second body section, the vent flow conduit is preferably positioned within the post-tensioning apparatus such that the entry opening of the vent flow conduit terminates in and communicates with a first location within a duct adjacent to the intermediate anchor head such that the first location is of greater cross-sectional area than a second location where the exit opening of the vent flow conduit terminates in and communicates with the transfer means utilized to route grout from the first body section, around and past the intermediate anchor head through the transfer means, and into an adjacent, second body section. In this embodiment, the vent flow conduit also preferably comprises a tube positioned entirely within the post-tensioning system. Utilizing the method of this embodiment of the present invention, the post-tensioning apparatus can be completely filled without air pockets by the hardenable material.

As can be appreciated by those of skill in the art, external tendons frequently, and in some circumstances always, will not have vents at high points inside the saddle due to access problems. As such, the vent flow apparatus and method of the present invention also has particular applicability for use with such external tendons.

It is therefore an object of the present invention to provide a novel vent flow conduit with general applicability for use in conduit or duct type apparatuses for passage of material therethrough in order to prevent formation of air pockets in internal portions thereof.

It is another object of the present invention to provide a novel vent flow conduit with particular applicability for post-tensioning systems for concrete or other suitable structures, including post-tensioning systems for concrete or other suitable structures which include first and second body sections interconnected in series by an intermediate anchor head and which utilize a transfer means for routing grout from the first body section, around and past the intermediate anchor head, and then into the second body section.

It is a further object of the present invention to provide a novel vent flow conduit which is simple to utilize and provides much-needed advantages in preventing formation of air pockets in conduit or duct type apparatuses for passage of material therethrough, such as post-tensioning systems for concrete or other suitable structures.

Some of the objects of the invention having been stated hereinabove, other objects will become evident as the description proceeds, when taken in connection with the accompanying drawings as best described hereinbelow.

DETAILED DESCRIPTION OF THE PREFERRED EMBODIMENT

Figure 1A:
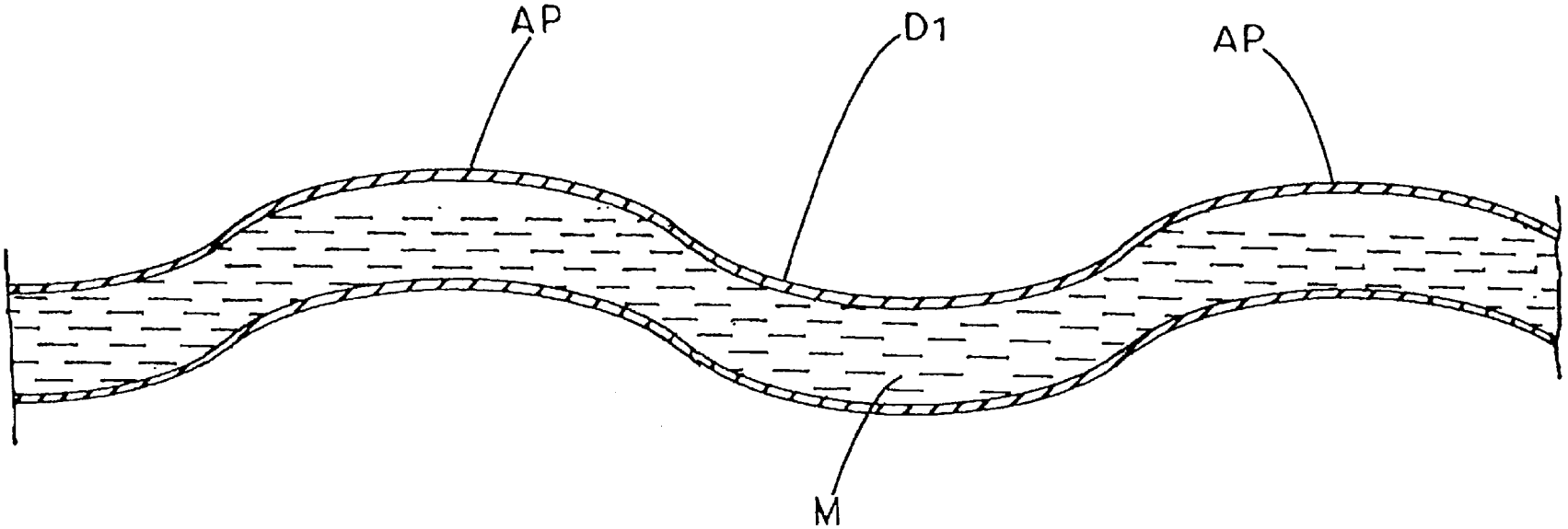
(PRIOR ART) FIG. 1A
FIG. 1A of the drawings is a sectional view of an elongated conduit or duct with material therein and with air pockets formed in elevated portions thereof.

As described in the background section above, it is common for elongated ducts to have certain internal portions or areas which have a great tendency for formation of air pockets by passage of material through such ducts. In this regard, FIG. 1A of the drawings illustrates an elongated duct D with material M positioned within duct D. It is envisioned according to this invention that duct D can be any duct of the type suitable for passage of material therethrough. As shown, duct D curves elevationally upwardly and downwardly. Material M typically is passed into and through duct D from either end of duct D, and, as illustrated in FIG. 1A, air pockets AP have formed in the upper, internal region or area of the curved portion of duct D. It is envisioned according to this invention that material M can be any type material suitable for passage through duct D, such as a hardenable material which can be in the form of grout.

Figure 1B:
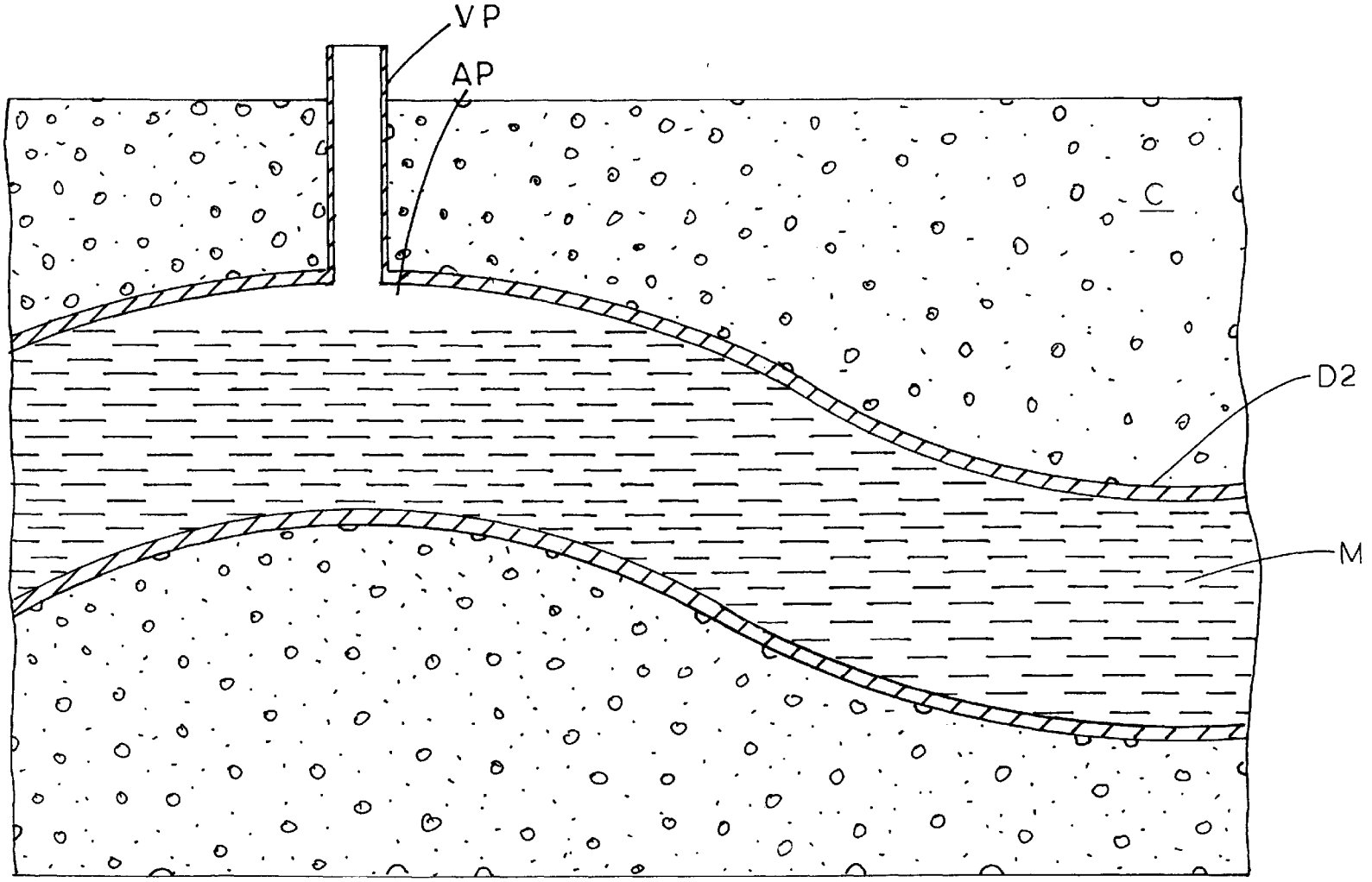
(PRIOR ART) FIG. 1B
FIG. 1B of the drawings is a sectional view of a portion of a prior art post-tensioning conduit or duct in concrete with material therein and with a vent pipe for filling the conduit with material.

Also as discussed in the background section hereinabove, it is common for post-tensioning systems for concrete or other suitable structures to utilize elongated, curved ducts for passage of hardenable material therethrough, and it has been common in such industry to utilize a vent pipe in communication with a duct of a post-tensioning system for material, such as concrete or another suitable material, in order to pass hardenable material into the duct in an effort to fill the inner portions of the duct as completely as possible. In this regard, FIG. 1B of the drawings illustrates a sectional view of a portion of a post-tensioning system for concrete where vent pipe VP connects and communicates with post-tensioning duct D2 which is surrounded by concrete C. Concrete C is used for illustrative purposes, and it is envisioned that any other suitable material or materials could likewise or similarly be used in accordance with this invention. Material M is positioned within duct D2 and typically is introduced into duct D2 through vent pipe VP and additionally can be introduced into duct D2 through one or both ends of duct D2 as known in conventional post-tensioning. Material M is preferably grout for post-tensioning systems but can be of any other type material suitable for passage into duct D2 and use with post-tensioning systems. As shown in FIG. 1B of the drawings, the air pocket AP which tends to form in upper internal, curved regions of duct D2 can be filled with material M through vent pipe VP in order to completely fill the inner portion of duct D2. Also as shown in FIG. 1B, vent pipe VP extends a distance beyond concrete C, as readily apparent to those of skill in the art of post-tensioning systems, and systems of this type therefore suffer from the disadvantages explained in the background section hereinabove.

Figure 2:
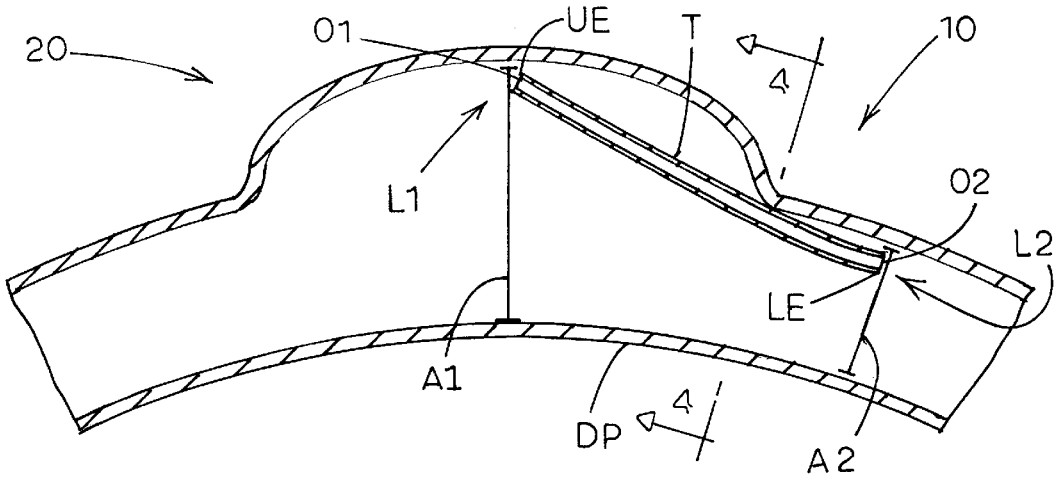
FIG. 2 of the drawings is a sectional view of a portion of an elongated conduit adapted for the present invention with a vent flow conduit positioned therein.
Figure 3A:
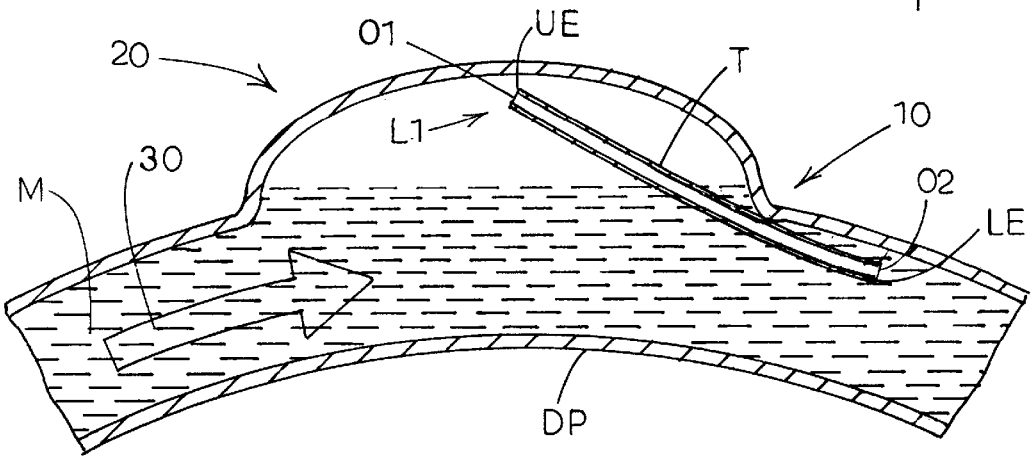
FIGS. 3A and 3B of the drawings are sectional illustrations of the embodiment shown in FIG. 2 illustrating material filling the conduit.
Figure 3B:
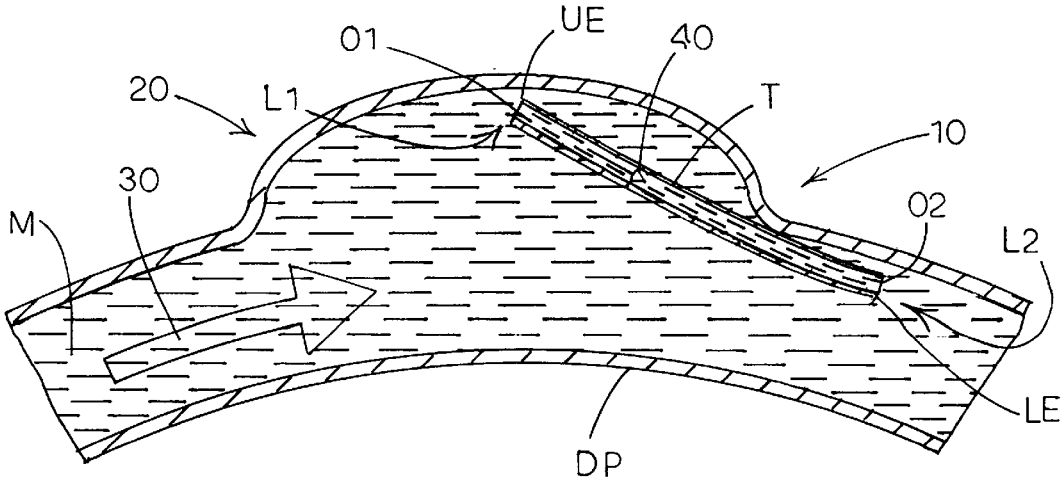
Figure 4:
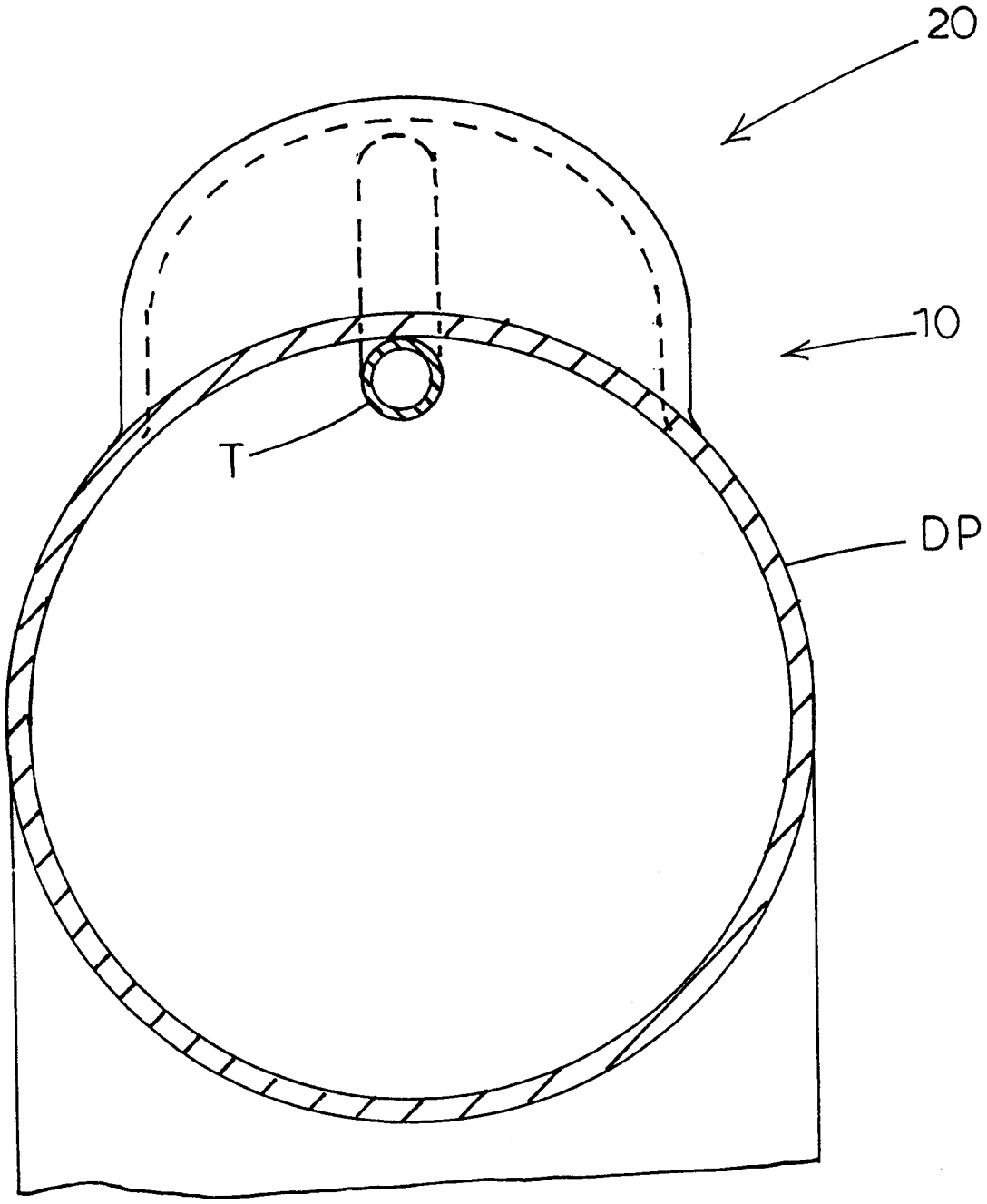
FIG. 4 of the drawings is front sectional view of the post-tensioning conduit shown in FIG. 2.

Referring now specifically to FIG. 2 of the drawings, a vent flow apparatus generally designated 10 is provided in accordance with one embodiment of the present invention for venting and filling air pockets in conduit or duct type apparatuses designed for passage of material therethrough, such as duct portion DP as shown in FIGS. 2, 3A and 3B. Duct portion DP represents the upper, curved portion of an elongated duct where air pockets tend to form inside. In accordance with the present invention, duct portion DP includes an area of increased or greater diameter, generally designated 20, wherein the area of greater diameter 20 comprises a bulbous formation on the top side of duct portion DP at a location as illustrated in FIGS. 2, 3A, 3B and 4 where air pockets tend to form by passage of material through duct portion DP. In this manner, the inner cross-sectional area of duct portion DP at the area of greater diameter 20 is greater than the inner cross-sectional area of portions of duct portion DP surrounding the area of greater diameter 20.

A hollow, vent flow conduit illustrated in the preferred embodiment in FIGS. 2, 3A, 3B and 4 as tube T is strategically positioned within duct portion DP in accordance with this invention. It is envisioned that tube T can comprise any type conduit suitable for passage of material therethrough while positioned within duct portion DP. In a preferred embodiment, tube T comprises a hollow, flexible tube with openings at both ends and which can be constructed of any suitable material, such as plastic, rubber or even metal for added strength. Tube T can be maintained in position within duct portion DP by any suitable means including, for example, adhesively affixing or mechanically fastening portions of tube T to appropriate inner portions of duct portion DP as long as tube T is positioned therein in accordance with the present invention for functioning as described hereinbelow.

The position of tube T within duct portion DP is preferably as illustrated in FIGS. 2, 3A, 3B and 4 of the drawings such that a first or upper, open, end UE, which defines an entry opening O1 therein, communicates with the inside of duct portion DP at a first location, generally designated L1, with the upper end UE of tube T therefore positioned within the inner area defined by area of greater diameter 20 of duct portion DP. The cross-sectional area of duct portion DP at first location L1 is therefore designated as area Al as shown specifically in FIG. 2 of the drawings.

The opposite end, which is the second or lower end LE of tube T, which defines exit opening O2, communicates with and is positioned in the inside of duct portion DP at a second location L2 which is outside of the area of greater diameter 20. As shown specifically in FIG. 2 of the drawings, the cross-sectional area of duct portion DP at location L2 is designated as area A2 as cross-sectional A2 is noticeably less than cross-sectional area A1. It is envisioned in accordance with this invention, however, that the locations of the first and second ends of tube T, referenced herein in a preferred embodiment as upper end UE and lower end LE, respectively, could vary within duct portion DP so long as tube T still functions according to the teachings herein. It is even envisioned that the first or upper end UE could be elevationally approximately the same or even lower than the second or lower end LE of tube T. The positioning as described herein of the vent flow conduit, shown in the preferred embodiment as tube T, within duct portion DP has been found to be tremendously beneficial when utilized in accordance with the present invention as described further hereinbelow for purposes of completely and easily filling an elongated duct with material by passage therethrough from one end of the duct toward the opposite end of the duct without the necessity of utilizing vent pipes between the ends of the duct.

Referring now to FIG. 3A of the drawings, duct portion DP has material M being advanced or passed therethrough from one end to the opposite end of duct portion DP in the direction illustrated by arrow 30. Again, material M can comprise any material suitable for passage through an elongated type conduit or duct in accordance with the present invention, and particularly can comprise grout when utilized with ducts for post-tensioning systems for concrete or other suitable structures. Since lower end LE of tube T is downstream from and, as preferred but not mandatory, elevationally lower than upper end UE of tube T, material M has already surrounded lower end LE of tube T while the level of material M within duct portion DP has not yet risen high enough to surround upper end UE or enter entry opening O1 of tube T within the area of greater diameter 20 of duct portion DP. In this instance as illustrated in FIG. 3A, material M is therefore not flowing through tube T from upper end UE to lower end LE.

Figure 5A:
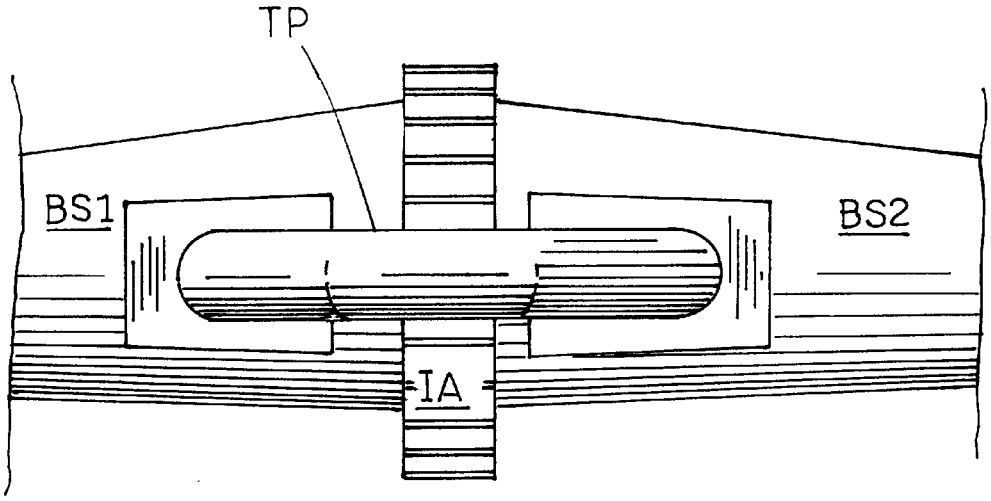
FIG. 5A of the drawings is a side elevation view with partial cutaway of a portion of a post-tensioning system for a concrete structure utilizing first and second body sections interconnected in series by an intermediate anchor head and utilizing a transfer means for routing material from the first body section, around and past the intermediate anchor head, and then into the second body section.
Figure 5B:
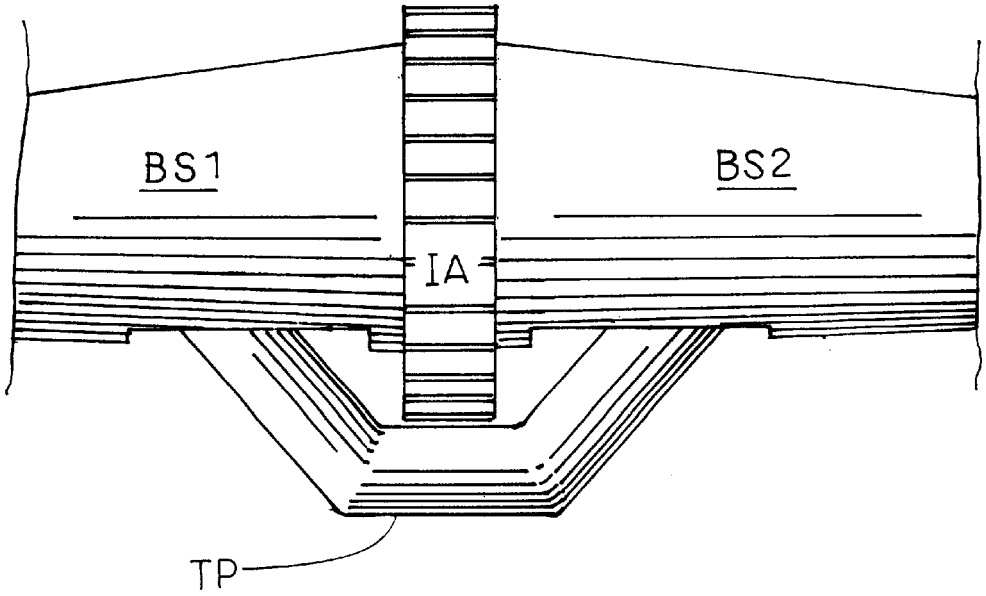
FIG. 5B of the drawings is a top plan view of FIG. 5A.

FIG. 3B of the drawings illustrates a progressed state from FIG. 3A in the process of filling duct portion DP with material M as material M has been advanced into duct portion DP such that the level of material M within the area of greater diameter 20 of duct portion has risen such that material M has entered entry opening O1 of upper end UE of tube T and is flowing in the direction of arrow 40 within tube T from upper end UE toward lower end LE. The smaller cross-sectional area A2 of duct portion DP at location L2 as compared to the greater cross-sectional area of duct portion DP at location L1 creates a pressure differential as well as differential velocity between locations L2 and L1 with respect to the flow of material M through duct portion DP. As such, material M flowing through tube T is drawn out of tube T through lower end LE and the area of greater diameter 20 of duct portion DP can be completely filled with material M without the formation of air pockets therein. Referring now specifically to FIGS. 5A and 5B of the drawings, a post-tensioning system is shown, which for illustrative purposes is for concrete, although it is envisioned that other suitable materials could also be used. The post-tensioning system includes two body sections BS1 and BS2 interconnected in series by an intermediate anchor head IA, which prevents flow of material therethrough, and with a transfer means in the form of transfer pipe TP communicating with body sections BS1 and BS2 in order to route grout between the body sections. This embodiment of a post-tensioning system is described in much greater detail in applicant's co-pending application Ser. No. 08/797,690, filed on Jan. 31, 1997, which is has been allowed and is incorporated herein by reference in its entirety.

Transfer pipe TP allows materials, usually in the form of grout, advancing through body section BS1 toward intermediate anchor head IA to pass into transfer pipe TP since the material cannot pass through intermediate anchor head IA. The material continues passing through transfer pipe TP in order to pass by intermediate anchor head IA and then into body section BS2 as can be appreciated by those in skill of the art of post-tensioning systems and as discussed in the above-referenced, co-pending application. In post-tensioning systems for concrete or other suitable structures as described immediately hereinabove and as illustrated in FIGS. 5A and 5B of the drawings, at least body section BS1 is typically a trumpet-shaped duct which increases in diameter toward intermediate anchor head IA. As can be appreciated by those of skill in the art of post-tensioning systems, and as described more fully in the above-identified, co-pending application, tendons (not shown) are utilized within body sections BS1 and BS2, and the tendons within each body section typically attach directly to the intermediate anchor head IA.

Material M in the preferable form of grout is passed through body section BS1, into and through transfer pipe TP, and then into body section BS2 such that the tendons within body sections BS1 and BS2 can be substantially encapsulated by grout. Unfortunately, the trumpet shape of body section BS1 adjacent intermediate anchor head IA can result in the tendency for formation of an air pocket within an upper, internal region of such body section wherein grout cannot completely fill the internal area of the body section.

Figure 6:
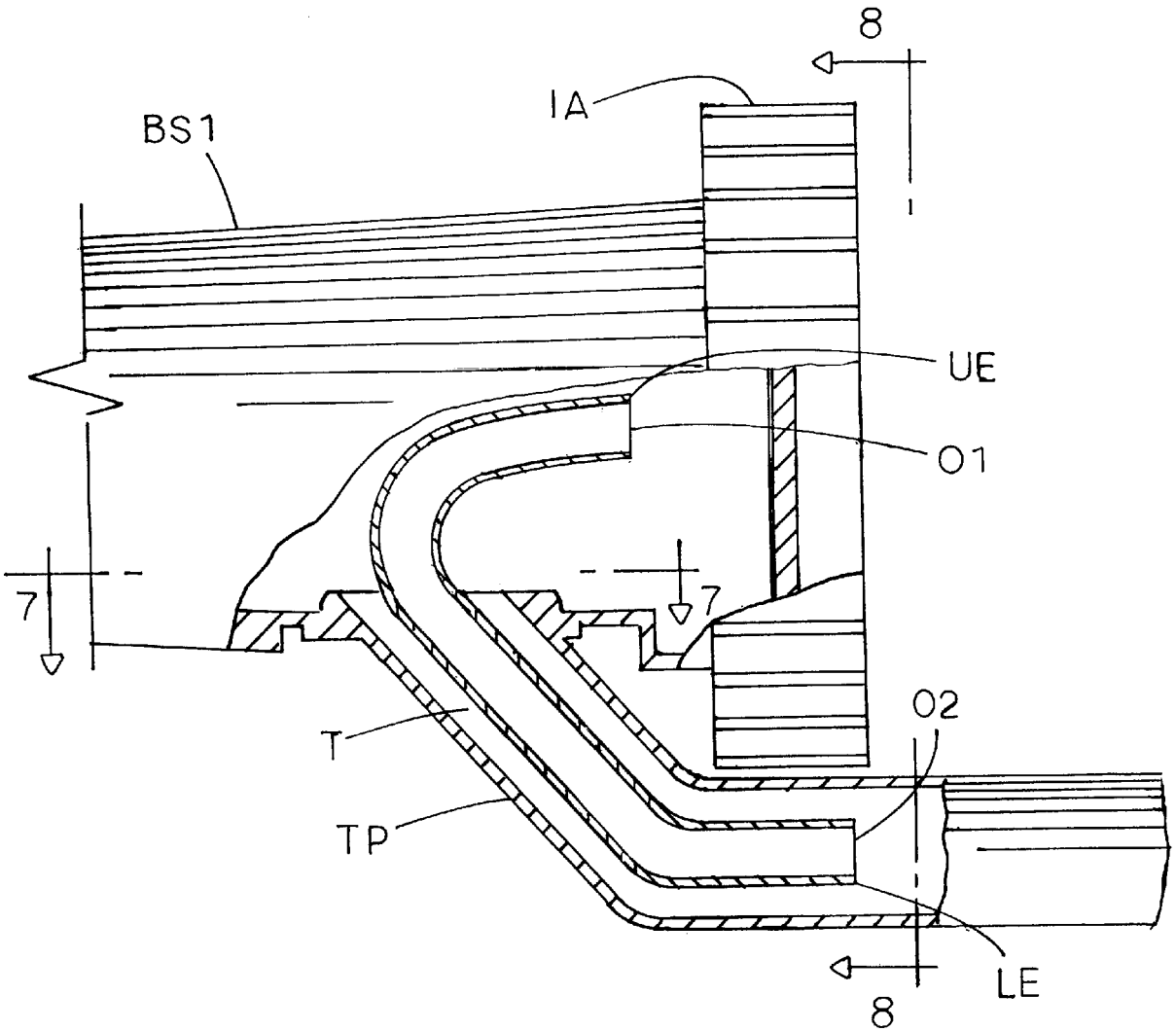
FIG. 6 of the drawings is a top plan view of a portion of a post-tensioning system as shown in FIGS. 5A and 5B with a portion thereof cut away for illustration of the vent flow conduit of the present invention.
Figure 7:
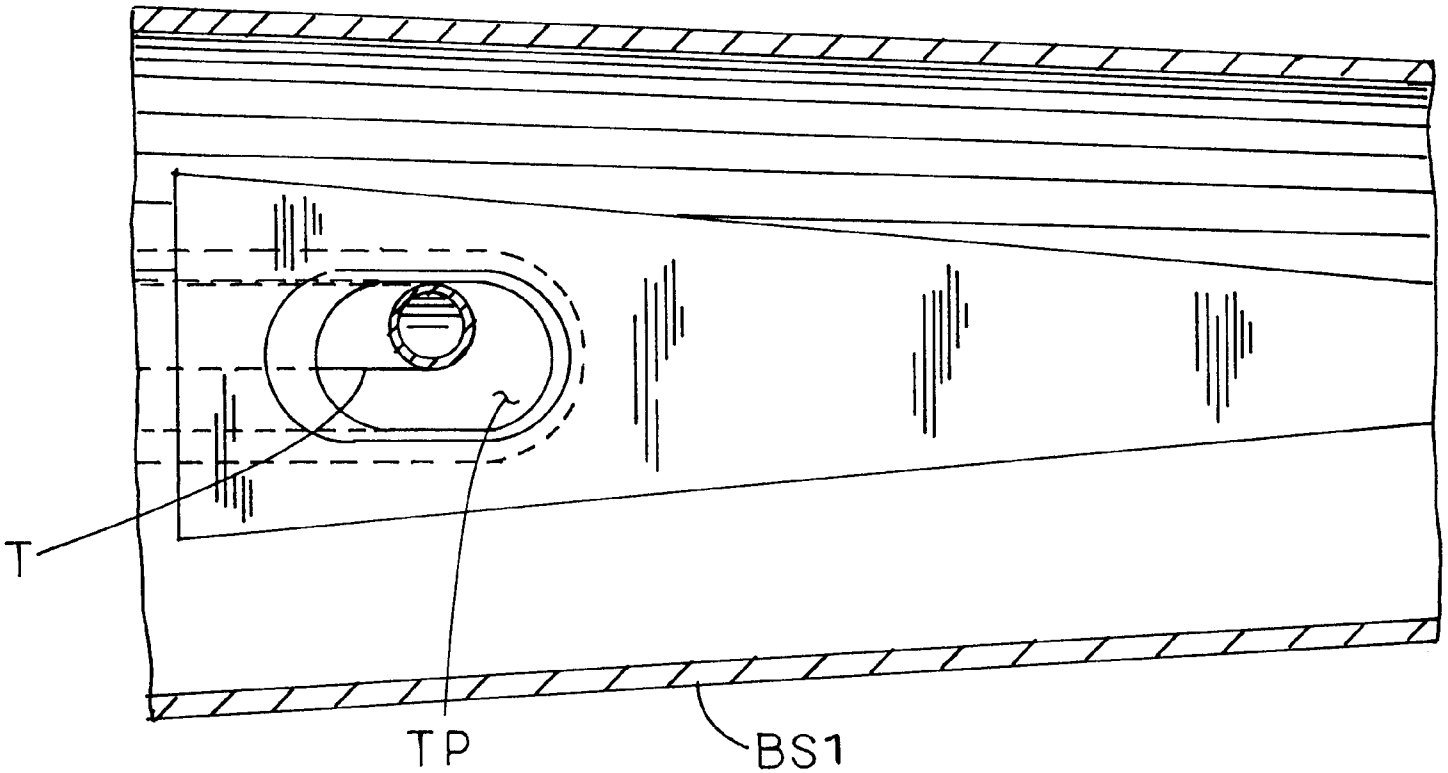
FIG. 7 of the drawings is a cross-sectional view drawn along line 7—7 of FIG. 6.
Figure 8:
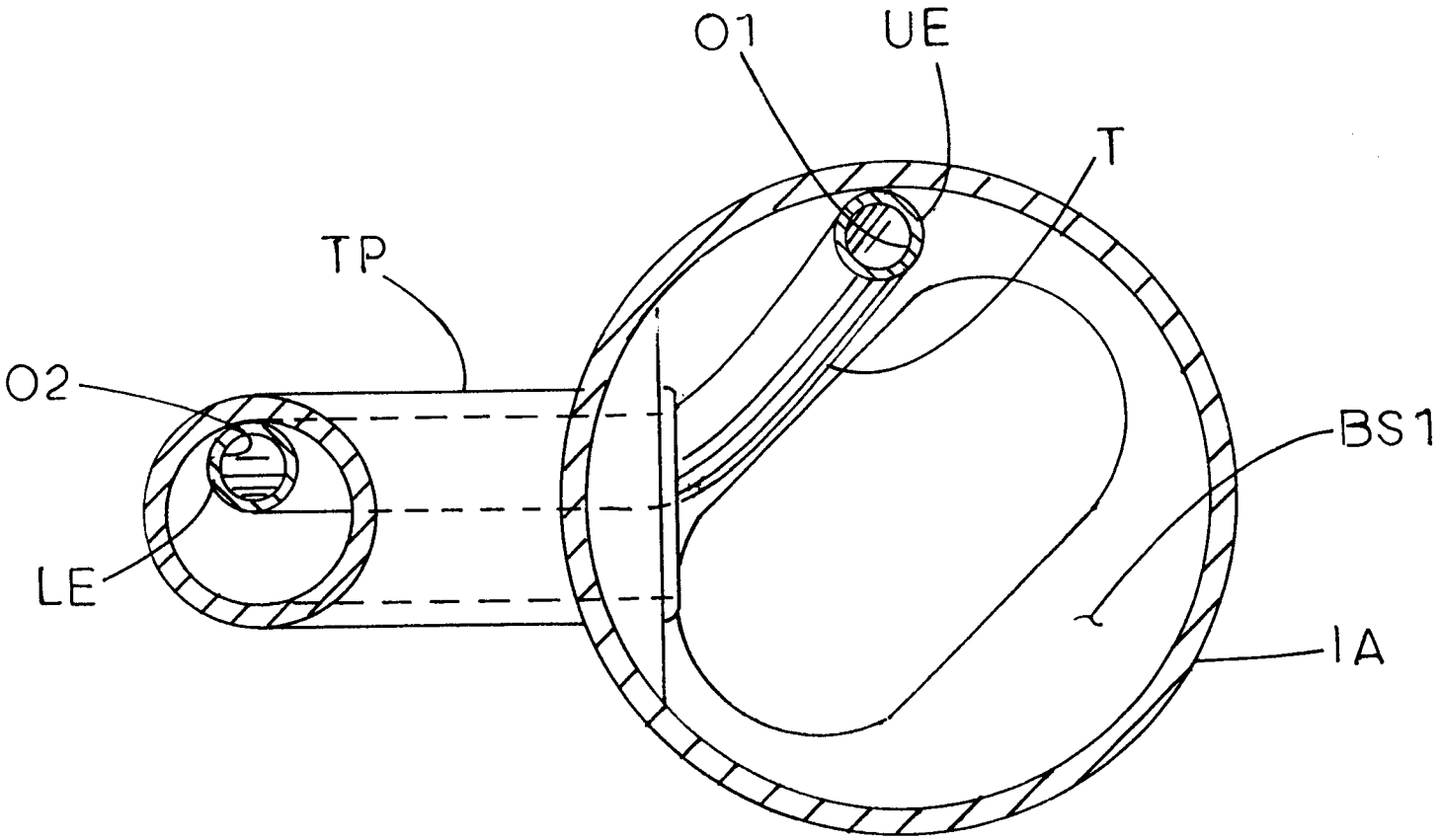
FIG. 8 of the drawings is a cross-sectional view drawn along line 8—8 of FIG. 6.

In accordance with the present invention, a vent flow conduit in the preferable form of a tube T is strategically maintained in position within body section BS1 and transfer pipe TP as illustrated specifically in FIGS. 6, 7 and 8 of the drawings. Tube T utilized within body section BS1 and transfer pipe TP can be maintained in position by any suitable means including, for example, adhesively affixing or mechanically fastening portions of tube T to appropriate inner portions of body section BS1 and transfer pipe TP as long as tube T is positioned therein in accordance with the present invention for functioning as described herein. Tube T within body section BS1 and transfer pipe TP can be constructed and shaped identically as tube T utilized within duct portion DP as described above and likewise preferably includes an upper end UE defining and entry opening O1 and an opposite and, although not mandatory but preferred, elevationally lower end LE defining an exit opening O2. Similar to the vent flow conduit in the form of tube T utilized with duct portion DP and described previously, tube T within body section BS1 and transfer pipe TP is positioned such that its upper end UE terminates in a preferred embodiment proximate a central portion of the upper internal side of body section BS1 and at a location where the diameter and cross-sectional area of body section BS1 are greater than the diameter and cross-sectional area of transfer pipe TP at the location of termination of lower end LE of tube T within transfer pipe TP as illustrated in FIGS. 6, 7 and 8 of the drawings. It is envisioned in accordance with this invention, however, that the locations of upper end UE and lower end LE of tube T could vary within body section BS1, even such that the first end referenced herein as upper end UE could be elevationally approximately the same or even elevationally lower than the second end referenced herein as lower end LE, so long as tube T still functions according to the teachings herein.

By the positioning of tube T within body section BS1 and transfer pipe TP as described hereinabove in a preferred embodiment and as illustrated in FIGS. 6, 7 and 8 of the drawings, grout filling body section BS1 as advanced therein through an end of body section BS1 opposite intermediate anchor head IA will ultimately rise to a level where the grout enters upper end UE of tube T. Because of the differences in cross-sectional area at the opposite ends of termination of tube T, as described previously, differential pressures and velocities draw grout through tube T from upper end UE to and through lower end LE and then continuing along transfer pipe TP. In this manner, grout can completely fill body section BS1 without formation of an air pocket in the upper region or area of body section BS1 adjacent intermediate anchor head IA.

Figure 9A:
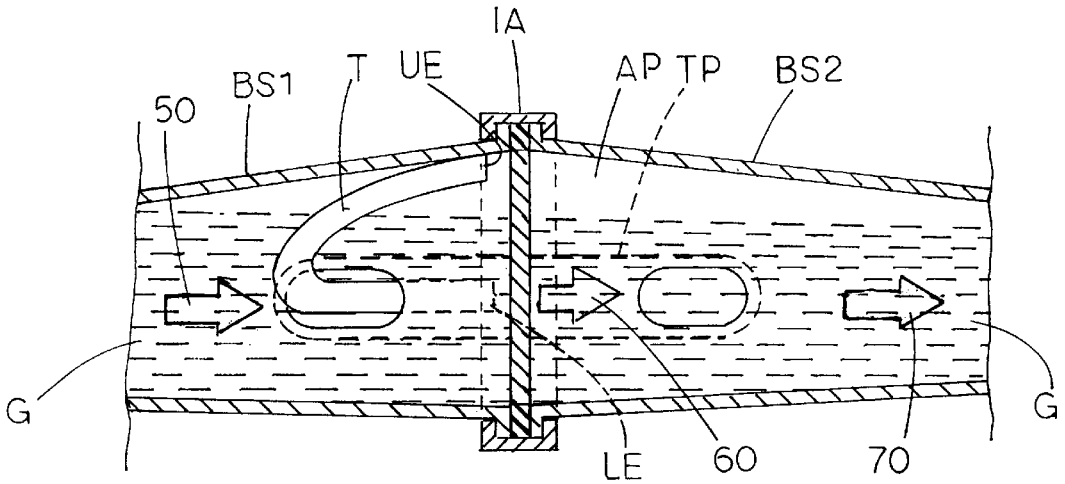
FIGS. 9A and 9B of the drawings are cutaway views illustrating the process of grout filling a portion of a post-tensioning system according to the present invention.
Figure 9B:
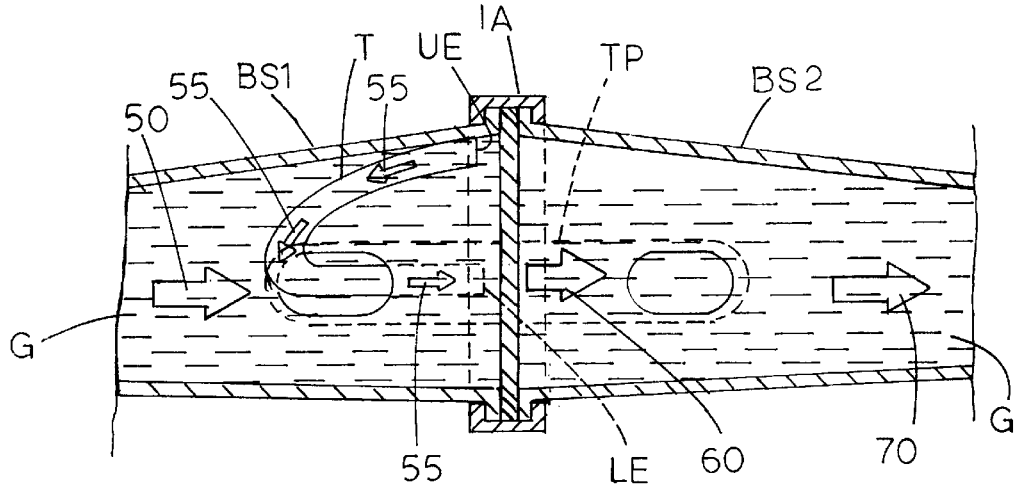

For illustration purposes, FIGS. 9A and 9B illustrate in cutaway views the process of filling body sections BS1 and BS2 with grout in accordance with the present invention. As illustrated in FIG. 9A of the drawings, grout G is advanced into body section BS1 in the direction of arrow 50 and has risen to a level within body section BS1 where air pocket AP has formed within the upper internal region or area of body section BS1 adjacent intermediate anchor head IA. At this point, grout G has not risen to a level where it can pass into upper end UE of tube T. Grout G, however, is passing or advancing through transfer pipe TP in the direction of arrow 60 and has already entered body section BS2.

FIG. 9B of the drawings illustrates an advanced progression from FIG. 9A in the grout filling process according to the present invention and shows grout G in body section BS1 completely filling body section BS1 without formation of an air pocket therein, as grout G has advanced through upper end UE of tube T and been routed by tube T in the direction of smaller arrows 55 toward and through lower end LE of tube T to continue in the direction of arrow 60 through transfer pipe TP. Grout G has also further filled body section BS2 and is advancing through body section BS2 in the direction of arrow 70. The passage of grout G through tube T as described herein therefore has allowed grout G to completely fill body section BS1 even in its upper, internal region or area adjacent intermediate anchor head IA. A second tube (not shown) can be used as desired with body section BS2 in order to completely fill body section BS2 without air pockets occurring as described with tube T and body section BS1.

It can therefore be seen that the present invention provides a novel vent flow conduit with general applicability for use in conduit or duct type apparatuses for passage of material therethrough in order to prevent formation of air pockets in internal portions thereof. It can also be seen that the present invention provides a novel vent flow conduit with particular applicability for external tendons lacking vents at high points due to access problems as known to those of skill in the art. Further, it can be seen that the present invention provides a post-tensioning systems for concrete or other suitable structures, including post-tensioning systems for concrete structures which include first and second body sections interconnected in series by an intermediate anchor head and which utilize a transfer means for routing grout from the first body section, around and past the intermediate anchor head, and then into the second body section.

It will be understood that various details of the invention may be changed without departing from the scope of the invention. Furthermore, the foregoing description is for the purpose of illustration only, and not for the purpose of limitation, as the invention is defined by the following, appended claims.

What is claimed is:

1. A vent flow apparatus for venting and filling air pockets in a duct for passage of material through said duct, said vent flow apparatus comprising:

(a) a hollow vent flow conduit having both an entry opening and a downstream exit opening with both of said openings being in communication with a duct for flow of a material through said duct; and (b) said entry opening of said vent flow conduit being in communication with said duct at a first location of greater cross-sectional area of said duct than a second location of communication of said exit opening of said vent flow conduit with said duct.

2. The vent flow apparatus of claim 1 wherein said vent flow conduit is positioned at least substantially within said duct.

3. The vent flow apparatus of claim 2 wherein said duct is formed by a tube.

4. The vent flow apparatus of claim 1 wherein said duct is a duct of a post-tensioning system for a concrete structure.

5. The vent flow conduit of claim 1 wherein said first location of said entry opening of said vent flow conduit with said duct is elevationally higher than said second location of communication of said exit opening of said vent flow conduit with said duct.

6. In a post-tensioning apparatus including a duct for passage of a hardenable material to fill said duct, and said duct having areas of higher and lower elevations, the improvement comprising a vent flow conduit comprising:

(a) a hollow vent flow conduit having both an entry opening and an exit opening with both of said openings being in communication with said duct for flow of hardenable material; and (b) said entry opening of said vent flow conduit being in communication with said duct at a first location of greater cross-sectional area of said duct than a second location of communication of exit opening of said vent flow conduit with said duct.

7. The vent flow conduit of claim 6 wherein said first location of said duct is upstream from said second location for a direction of flow of the hardenable material through said duct.

8. The vent flow conduit of claim 6 wherein the vent flow conduit is positioned at least substantially within said duct.

9. The vent flow conduit of claim 8 wherein said duct is formed by a tube positioned entirely within said duct and said first location of said duct is elevationally higher than said second location of said duct.

10. A method of venting and filling air pockets in a duct for passage of a material through said duct, said method comprising the steps of:

(a) providing a vent flow conduit having an entry opening and an exit opening;

(b) positioning said vent flow conduit in communication with a duct for passage of material such that said entry opening of said vent flow conduit communicates with said duct at a first location prone to formation of air pockets upon passage of material through said duct, said duct at said first location being of greater cross-sectional area of said duct than a second location of said duct where said exit opening of said vent flow conduit communicates with said duct;

(c) passing material through said duct in a direction where said material flows from said first location towards said second location; and (d) at least substantially filling said duct with said material substantially without air pockets within said by passage of said material through said vent flow conduit from said entry opening to said exit opening.

11. The method of claim 10 wherein said duct is filled with said material without externally venting said duct.

12. The method of claim 11 wherein said vent flow conduit is positioned entirely within said duct.

13. A method of venting and filling air pockets in a duct of a post-tensioning apparatus, wherein said duct has areas of higher and lower elevations for at least substantially filling said duct, said method comprising the steps of:

(a) providing a vent flow conduit having an entry opening and an exit opening;

(b) positioning said vent flow conduit within a duct of said post-tensioning apparatus such that said entry opening of said vent flow conduit communicates with said duct at a first location prone to formation of air pockets upon passage of a hardenable material through said duct, said first location being of greater cross-sectional area of said duct than a second location of said duct where said exit opening of said vent flow conduit communicates with said duct;

(c) passing said hardenable material through said duct in a direction where said hardenable material flows from said first location to said second location; and (d) at least substantially filling said duct with said hardenable material substantially without air pockets by passage of said hardenable material through said vent flow conduit from said entry opening to said exit opening.

14. The method of claim 13 wherein said hardenable material is passed through said duct such that said hardenable material passes by said exit opening of said vent flow conduit at a greater velocity than that at which said hardenable material passes by said entry opening of said vent flow conduit through said duct.

15. In a post-tensioning apparatus comprising at least a first and second body section interconnected at least partially in series by an intermediate anchor head with each body section having a duct defining a passage therein for a post-tensioning tendon and for passage of a hardenable material through said duct, said apparatus further comprising transfer means communicating with said duct of each body section and providing a passageway for passage of hardenable material from said duct of said first body section, around said intermediate anchor head, and into said duct of said second body section, the improvement comprising a vent flow apparatus forventing and substantially filling elevated areas within said duct of said first body section prone to formation of air pockets, said vent flow apparatus comprising:

(a) a hollow vent flow conduit positioned within said post-tensioning apparatus and having both an entry opening and a downstream exit opening; and (b) said entry opening of said vent flow conduit being in communication with said duct of said first body section at a first location, and said exit opening of said vent flow conduit being in communication with and terminating in said transfer means at a second location of lesser cross-sectional area than that of said first location.

16. The vent flow conduit of claim 15 wherein said first location of communication of said entry opening of said vent flow conduit with said duct of said first body section is elevationally higher than said second location of communication of said exit opening of said vent flow conduit with said transfer means.

17. The vent flow conduit of claim 15 wherein said vent flow conduit is a tube.

18. In a post-tensioning apparatus, said apparatus comprising:

(a) at least a first and second body section interconnected in series by an intermediate anchor head with each body section having an end anchor head, each body section comprising a tendon including at least a pair of strands adapted for post-tensioning between said intermediate anchor head and a corresponding end anchor head with one end of each pair of strands being connected to said intermediate anchor head and an opposite end of each pair of strands being connected to said corresponding end anchor head, each pair of strands being encapsulated between said intermediate anchor head and said corresponding end anchor head in a duct defined by one or more duct sections, each duct adapted to receive a bonding agent after post-tensioning of the pair of strands therein such that the pair of strands therein can be bonded in position within the duct;

(b) passage means proximate the end anchor head of said first body section and providing a passage for insertion of bonding agent into the duct of said first body section; and (c) transfer means providing a passage for bonding agent in the duct of said first body section to pass past said intermediate anchor head into the duct of said second body section;

the improvement comprising a vent flow apparatus for venting and substantially filling elevated areas within one or more duct of said first body section, said vent flow apparatus comprising:

(d) a hollow vent flow conduit positioned within said post-tensioning apparatus and having both an entry opening and a downstream exit opening; and (e) said entry opening of said vent flow conduit being in communication with a duct of said first body section at a first location, and said exit opening of said vent flow conduit being in communication with and terminating in said transfer means at a second location of lesser cross-sectional area than that of said first location.

19. A method of venting and filling air pockets with a hardenable material in a post-tensioning apparatus, said method comprising the steps of:

(a) providing a post-tensioning apparatus comprising at least a first and second body section interconnected in series by an intermediate anchor head with each body section having a duct defining a passage therein for a post-tensioning tendon and for passage of a hardenable material through said duct, said apparatus additionally comprising transfer means communicating with said duct of each body section and providing a passageway for passage of hardenable material from said duct of said first body section, around said intermediate anchor head, and into said duct of said second body section, and said apparatus further comprising a vent flow conduit positioned within said apparatus and having an entry opening and an exit opening, said entry opening positioned within and communicating with said duct of said first body section at a first location and said exit opening of said vent flow conduit positioned within and communicating with said transfer means at a second location of lesser cross-sectional area than that of said first location;

(b) passing a hardenable material through said duct of said first body section toward said intermediate anchor head wherein said hardenable material then passes through said transfer means into said duct of said second body section; and (c) at least substantially filling said duct of said first body section with said hardenable material substantially without air pockets by passage of said hardenable material through said vent flow conduit from said entry opening to said exit opening.

* * * * *